US006997599B2

(12) United States Patent
Gallup

(10) Patent No.: US 6,997,599 B2
(45) Date of Patent: Feb. 14, 2006

(54) WASTE MUD AGITATION SYSTEM

(76) Inventor: Gordon Leroy Gallup, Box 352, Rosemary, Alberta (CA) T0J 2W0

( * ) Notice: Subject to any disclaimer, the term of this patent is extended or adjusted under 35 U.S.C. 154(b) by 0 days.

(21) Appl. No.: 10/443,232

(22) Filed: May 22, 2003

(65) Prior Publication Data

US 2004/0231891 A1 Nov. 25, 2004

(51) Int. Cl.
*B09K 7/00* (2006.01)
*B01F 5/00* (2006.01)

(52) U.S. Cl. ..... 366/176.1; 175/66

(58) Field of Classification Search ..... 366/136, 366/137, 177.1, 173.2, 167.1, 173.1; 298/17 R; 175/206, 207, 66; 134/166 R; 210/519
See application file for complete search history.

(56) References Cited

U.S. PATENT DOCUMENTS

| | | | | | |
|---|---|---|---|---|---|
| 981,098 | A * | 1/1911 | McCaskell | 366/167.1 |
| 1,716,297 | A * | 6/1929 | Bond | 366/173.1 |
| 2,267,608 | A * | 12/1941 | Hawley | 210/523 |
| 2,694,555 | A * | 11/1954 | Sinkwich | 366/167.1 |
| 3,233,874 | A * | 2/1966 | Betulius | 366/167.1 |
| 3,491,949 | A * | 1/1970 | Hairston | 239/127 |
| 3,759,279 | A * | 9/1973 | Smith, Jr. | 137/1 |
| 3,808,631 | A * | 5/1974 | Shibata et al. | 134/175 |
| 3,810,604 | A * | 5/1974 | Reiter | 366/167.1 |
| 4,024,881 | A * | 5/1977 | Weiland et al. | 134/104.4 |
| 4,285,601 | A * | 8/1981 | Miner | 366/137 |
| 4,335,982 | A * | 6/1982 | Bratschitsch | 406/48 |
| 4,447,157 | A * | 5/1984 | Underwood | 366/137 |
| 4,474,254 | A * | 10/1984 | Etter et al. | 366/136 |
| 4,708,488 | A * | 11/1987 | Ericsson | 366/137 |
| 4,913,819 | A * | 4/1990 | Patterson | 210/523 |
| 5,002,595 | A * | 3/1991 | Kehr | 55/312 |
| 5,050,995 | A * | 9/1991 | Lucore, II | 366/136 |
| 5,055,204 | A * | 10/1991 | Bogart | 210/758 |
| 5,147,133 | A * | 9/1992 | White | 366/138 |
| 5,613,510 | A * | 3/1997 | Proctor | 134/166 R |
| 5,671,979 | A * | 9/1997 | Poborsky | 298/17 R |
| 5,774,816 | A * | 6/1998 | Fontenot et al. | 588/1 |
| 6,533,946 | B1 * | 3/2003 | Pullman | 175/206 |
| 2002/0000748 | A1 * | 1/2002 | Fuller et al. | 298/17 R |

* cited by examiner

*Primary Examiner*—Tony G. Soohoo
(74) *Attorney, Agent, or Firm*—G. F. Gallinger

(57) ABSTRACT

An agitation system for a mud tank to prevent core material initially suspended in the drilling mud, from settling. The method agitates sludge and eliminates the need to hand shovel sludge from the tank after dumping. The method comprises the step of pumping mud taken from within the tank through a permanently mounted rubber nozzle directed at mud on a bottom portion of the tank. In a preferred aspect of this invention the tank is a cylindrical and longitudinally mounted on a truck for waste mud hauling, and has a rear end cap hinged to a top portion of the tank, so that when a front portion of the tank is marginally elevated and the end cap is hinged opened, mud dumps from a rear end portion of the tank.

9 Claims, 1 Drawing Sheet

WASTE MUD AGITATION SYSTEM

FIELD OF THE INVENTION

Figure 1:
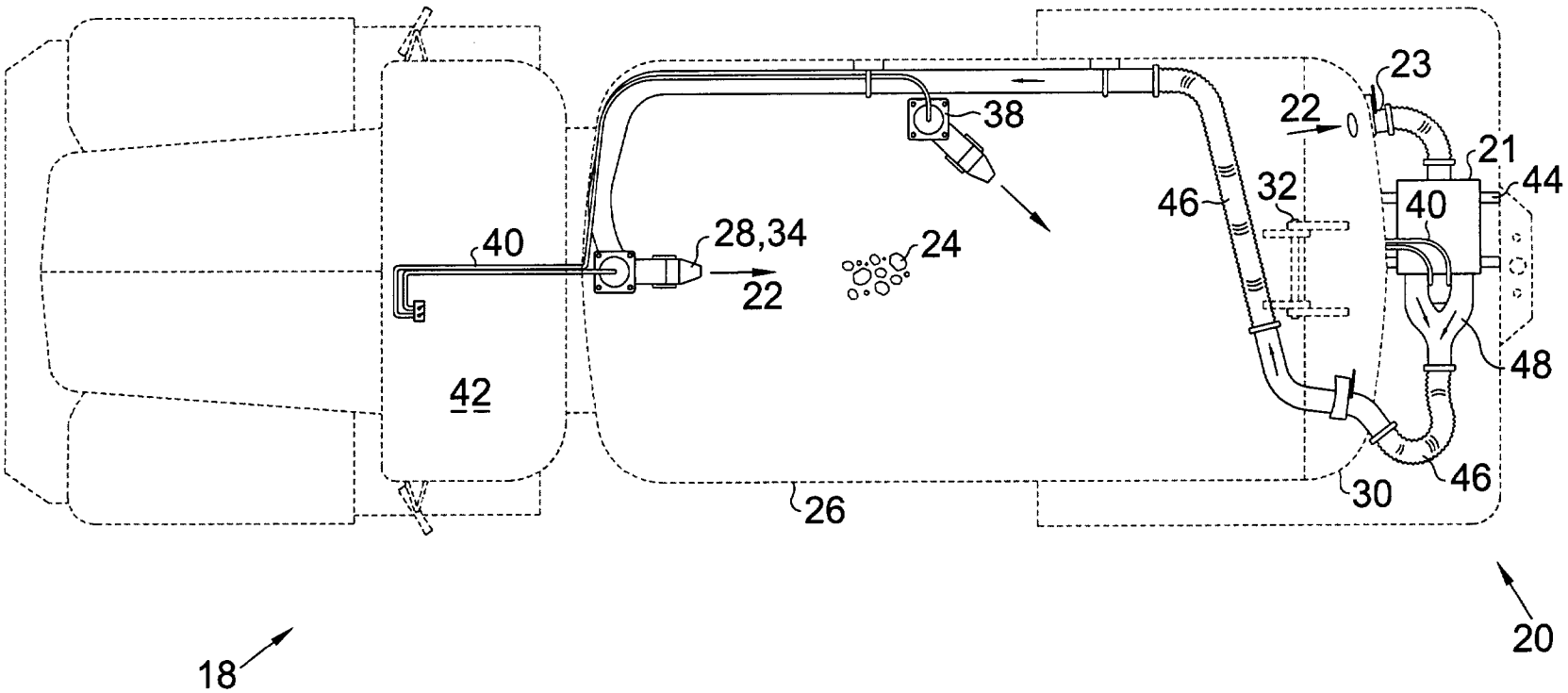

This invention relates to removal of used drilling mud from petroleum drilling rigs. More particularly this invention relates to an agitation system for a vacuum mud tank truck. The system prevents core material, initially suspended in the drilling mud, from settling on the bottom of the tank on the mud truck.

BACKGROUND OF THE INVENTION

The inventor is engaged in the business of waste mud disposal. When a well is drilled, mud is pumped down the well hole to cool the cutting head and remove the core material which has been cut beneath the cutting head. The used drilling mud having core material suspended therein must be hauled away from the well site for disposal. The used mud having core material suspended therein is pumped into tank trucks to be hauled away. At a disposal location, a front portion of the tank on the tank truck is lifted a few feet and a rear end cap of the tank hinges open from a hinge on the tank top, then the waste mud within the tank will flows out of the tank.

One common problem with this equipment and method of waste mud disposal is that the suspended core material in the waste mud settles on the tank bottom. Then when the mud flows out of the tank a substantial portion of the core material remains as sludge on the tank bottom. Drivers must climb and squeeze into the opened tank to shovel out this muddy sludge. Removal of this muddy sludge is very time consuming. It is also heavy and dirty work. This sludge must be removed when it is extremely cold or extremely hot. Particularly when there is shale in the mud, there is a substantial amount of sludge that will not run out of the tank, and a large amount of shovelling for the driver.

OBJECTS OF THE INVENTION

It is an object of this invention to disclose a method to eliminate the heavy and messy shovelling of sludge from a waste mud hauling truck. It is an object of this invention to eliminate the most disliked part of a waste truck driver's job turnover. It is a final object of this invention to promote efficient dumping.

One aspect of this invention provides for a method of facilitating more complete removal of waste drilling mud having core material therein from a tank comprising the step of pumping mud taken from within the tank through a permanently mounted nozzle within the tank, said nozzle directed at mud on a bottom portion of the tank to agitate settled core material once suspended in the mud.

In the most preferred embodiment of the invention, there are two nozzles, each directed at a different portion of the tank bottom side portion, and each nozzle has a tapered rubber discharge portion to accommodate ejection of oversized material in the mud.

In a preferred aspect of this invention the tank is a cylindrical and longitudinally mounted on a truck for waste mud hauling, and the tank has a rear end cap hinged to a top portion of the tank, so that when a front portion of the tank is marginally elevated and the end cap is hinged opened, then mud dumps from a rear end portion of the tank beneath the hinged end cap.

Various other objects, advantages and features of this invention will become apparent to those skilled in the art from the following description in conjunction with the accompanying drawings.

FIGURES OF THE INVENTION

FIG. 1 is a plan view of a waste mud truck fitted with a mud agitation system to facilitate complete dumping of waste mud and the core material suspended therein.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a plan view of a waste mud truck 18 fitted with a mud agitation system 20 to facilitate complete dumping of waste mud 22 having core material 24 therein. A method of facilitating more complete removal of waste drilling mud 22 having core material 24 therein from a tank 26 comprises the steps of: pumping 21 mud 22 taken from within the tank 26 through a permanently mounted nozzle 28 within the tank 26. Said nozzle 28 is directed at mud 22 on a bottom portion of the tank 26 to agitate settled core material 34 once suspended in the mud 22. The cylindrical tank 26 can accommodate both vacuum used to intake mud 22 and air pressure used to discharge mud 22.

In a preferred embodiment of the invention the tank 26 is cylindrical and longitudinally mounted on a truck 18 for waste mud hauling. The tank 26 has a rear end cap 30 which is hinged 32 to a top portion of the tank 26. When a front portion of the tank 26 is marginally elevated and the end cap 30 is hinged 32 open, then mud 22 dumps from a rear end portion of the tank 26 beneath the hinged end cap 30. Inclusion of the agitation system 20 would facilitate more complete dumping of waste mud 22. The agitation system 20 would even allow some muds 22 to be spread on the ground using an outlet positioned on a lower portion of the tank 26.

In the most preferred embodiment of the invention the nozzle 28 has a tapered rubber discharge portion 34 to accommodate ejection of oversized material 24 in the mud 22. Most preferably there are two nozzles 28 each directed at a different portion of the tank 26 bottom side portion. One of the nozzles 28 is directed down and rearwardly to a front bottom side portion of the tank 26, and the other is directed down and rearwardly to a central bottom side portion of the tank 26. The nozzles 28 are adjustably mounted within the tank 26 to facilitate optimal adjustment.

Mud 22 feed to each of the two nozzles 28 is controlled by a remotely controlled valve 38, motivated by pressurized air, so that discharge pressure may be maximized by alternatively discharging from the valves 38 within the tank 26 thereby more effectively agitating the mud 22. Control lines 40 from the pump 21 and the valves 38, extend to the cab 42 of the truck 18 to permit remote operation from the cab 42.

The mud circulation pump 21 is centrally mounted adjacent to an end of the cylindrical tank 26. In the aspect of the invention illustrated, the pump 21 is mounted on a frame 44 beneath a rear end portion of the tank 26. A flexible hose 46 extends between a discharge end portion of the pump 21 and the end cap 30 of the tank 26 and within the end cap 30 of the tank 26 for transmission to one nozzle 28 to thereby accommodate rotating movement of the end cap 30.

The inventor has found that 4" diameter flexible hosing 46, piping 48, and valves 38 is an optimum size. The rubber nozzles 34 have a discharge diameter of 1¾". This diameter maximizes discharge velocity and is able to accommodate core material which is generally between ½ and 1½" in diameter. One nozzle 28 is positioned 8" off the floor with a 45 degree pitch to agitate the front half of the tank 26, and the other second nozzle is located in the middle of the tank 26 to provide agitation for the rear half of the tank 26.

While the invention has been described with preferred specific embodiments thereof, it will be understood that this description is intended to illustrate and not to limit the scope of the invention, which is defined by the following claims.

I claim:

1. A method of facilitating more complete removal of waste drilling mud having core material therein from a tank comprising the step of:

pumping mud taken from within the tank through a permanent mounted nozzle within the tank, said nozzle directed at mud on a bottom portion of the tank to agitate settled material once suspended in the mud;

wherein the nozzle has a tapered rubber discharge portion at its effluent end portion to accommodate ejection of oversized material in the mud;

and wherein the tank is a cylindrical and longitudinally mounted on a truck for waste mud hauling, and the tank has a rear end cap hinged to a top portion of the tank, so that when a front portion of the tank is marginally elevated and the end cap is hinged opened, then mud dumps from a rear end portion of the tank beneath the hinged end cap.

2. A method as in claim 1 wherein there are two nozzles each directed at a different portion of the tank bottom side portion.

3. A method as in claim 2 wherein mud feed to each of the two nozzles is controlled by a remotely controlled valve so that discharge pressure may be maximized by alternatively discharging from the valves and the mud within the tank may be more effectively agitated.

4. A method as in claim 3 wherein the valve is motivated by pressurized air.

5. A method as in claim 3 wherein control lines from the pump and the valves, extend to the cab of the truck to permit remote operation from the cab.

6. A method as in claim 2 wherein one of the nozzles is directed down and rearwardly to a front bottom side portion of the tank, and the other is directed down and rearwardly to a central bottom side portion of the tank.

7. A method as in claim 6 wherein the nozzles are adjustably mounted within the tank to facilitate optimal adjustment.

8. A method as in 6 wherein a mud circulation pump is centrally mounted adjacent to an end of the cylindrical tank.

9. A method as in claim 8 wherein the pump is mounted on a frame beneath a rear end portion of the tank, and wherein a flexible hose extends between a discharge end portion of the pump and the end cap of the tank, and within the end cap of the tank for mud transmission to one nozzle, to thereby accommodate rotating movement of the end cap.

* * * * *